US006029410A

United States Patent [19]

Westberg, II et al.

[11] Patent Number: 6,029,410

[45] Date of Patent: Feb. 29, 2000

[54] DOOR GUARD

[75] Inventors: John K. Westberg, II, South Portland; Richard Sweeney, Falmouth; Bernie P. Kimball, Gorham, all of Me.

[73] Assignee: Tenneco Packaging Inc., Evanston, Ill.

[21] Appl. No.: 09/009,222

[22] Filed: Jan. 20, 1998

[51] Int. Cl.[7] ..... E06B 1/04

[52] U.S. Cl. ..... 52/204.1; 206/591; 206/594; 206/325

[58] Field of Search ..... 206/325, 591, 206/594; 52/204.1

[56] References Cited

U.S. PATENT DOCUMENTS

| | | | |
|---|---|---|---|
| 2,742,146 | 4/1956 | Lester, Jr. | 206/60 |
| 2,929,495 | 3/1960 | Simonsen | 206/60 |
| 4,127,188 | 11/1978 | Heaney | 206/453 |
| 4,967,905 | 11/1990 | Steves | 206/321 |

OTHER PUBLICATIONS

Prior Art Door Guard Ref No. 970049 (original).

Prior Art Door Guard Ref. No. 970049 (photo).

*Primary Examiner*—Carl D. Friedman
*Assistant Examiner*—Nkeisha J. Maddox
*Attorney, Agent, or Firm*—Arnold White & Durkee

[57] ABSTRACT

A door guard for protecting a door assembly including a door frame and moldings positioned about a door. Guide channels are provided on the base of the door guard for receiving tightening straps to secure the door guard to the door assembly. Raised ridges are provided on the outer side panels of the door guard to receive the tightening straps and communicate tightening pressure to the door guard. A raised block is provided on an inside surface of the door guard to maintain separation of the moldings in response to the tightening pressure. A pad is provided on an outside surface of the door guard to cushion the end of the door assembly.

33 Claims, 5 Drawing Sheets

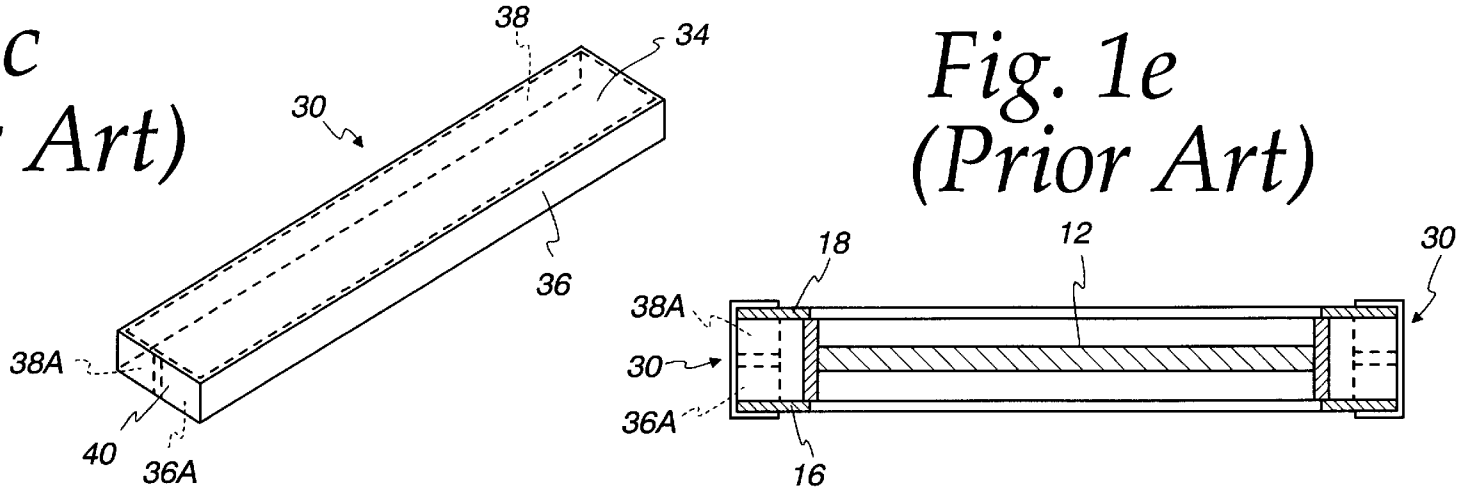
Fig. 1e (Prior Art)
Fig. 1c (Prior Art)
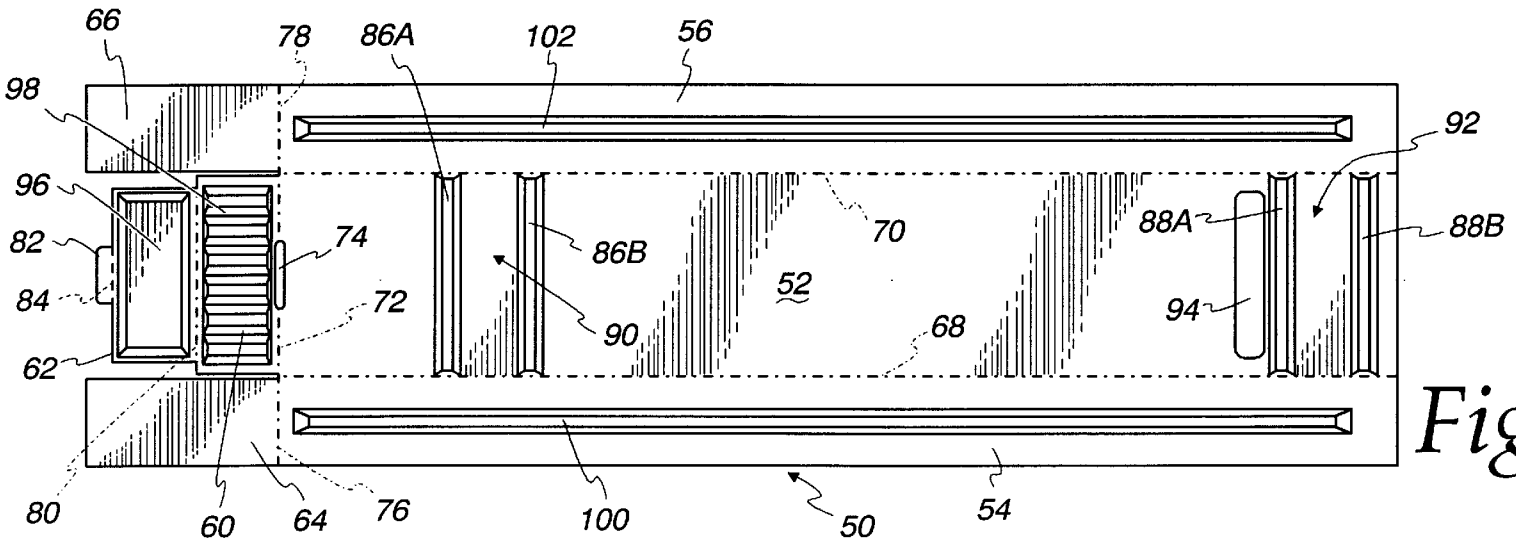
Fig. 2

DOOR GUARD

FIELD OF THE NVETION

The present invention relates generally to protective packaging devices and, more particularly, to devices which are designed and arranged to protect door assemblies from damage during shipping and handling.

BACKGROUND OF THE INVENTION

Door manufacturers and retailers are known to transport and sell their products in assembled form with frames and moldings. To protect the door assemblies from damage due to shipping and handling, it is common for the manufacturer or retailer to place protective guards around the outer surface, or portion thereof, of the door assemblies. One common practice, for example, is to use a combination of four protective guards, with each guard being positioned at one of the four comer regions of the door assembly. Presently, such guards are made of corrugated cardboard folded and glued into four-sided "boxes" which fit relatively loosely around the respective comer regions of the door assembly and are held in place with nylon straps. Although the cardboard guards offer a degree of protection to the door assembly as it is manipulated during shipping and handling, there are a variety of problems associated with the cardboard guards. One such problem, for example, relates to the difficulty of adequately securing the guards to the door assemblies. The presently used cardboard guards have a tendency to shift out of position or fall off entirely as the nylon straps are moved and/or loosened during shipping and handling. A factor contributing to this problem is that the nylon straps apply inward pressure to the door assembly and cannot be secured too tightly without causing the door assembly (and, more specifically, its moldings) to collapse. Other problems associated with the cardboard guards is that they offer only a limited degree of protection to the door assembly and have a tendency to rip or tear if they are grasped upon lifting or moving of the door assembly.

Consequently, there is a need for a novel door guard structure which offers a greater degree of protection than present cardboard guards and which may be securely and tightly retained about the comer regions of a door guard assembly. The present invention is directed to providing a door guard that satisfies the aforementioned needs and overcomes or at least reduces the effects of one or more of the problems set forth above.

SUMMARY OF THE INVENTION

In accordance with one aspect of the present invention, there is provided a door guard for protecting portions of a door assembly, the door assembly including a door frame and moldings positioned about a door, the moldings including front and back moldings defining a channel therebetween. The door guard comprises a base, a first and second side panel connected to the base, and an end section connected to the base. The base is adapted to engage outer edges ofthe front and back moldings of the door assembly, the first and second side panels are adapted to engage outer surfaces of the front and back moldings of the door assembly, and the end section is adapted to engage end portions of the front and back moldings of the door assembly. An outer surface of the base is provided with groups of projections defining guide channels therebetween within which tightening straps are received to secure the base to the door assembly. In one embodiment, the groups of projections comprise opposing pairs of parallel ridges extending substantially across a width of the base. In another embodiment, the groups of projections comprise opposing sets of discrete projections, each of the opposing sets being aligned along a parallel axis extending across a width of the base.

In still another embodiment, the end section of the door guard includes a raised block adapted to project into the channel between the front and back moldings. The raised block is adapted to maintain separation of the front and back moldings in response to compression of the moldings by said tightening straps. In yet another embodiment, the end section of the door guard includes a plurality of raised ridges on its outer surface. The raised ridges define a pad which is adapted to cushion the end portions of the door assembly. In a further embodiment, the first and second side panels of the door guard include a raised compression ridge on their outer surface. The compression ridges are adapted to communicate a tightening force to the side panels in response to inward compression of the side panels by the tightening straps. In a still further embodiment, an opening is provided in the base of the door guard adjacent to one of the guide channels. The opening is adapted to provide finger access between the door assembly and a portion of the base underneath the guide channel to facilitate lIfting of the door assembly.

BRIEF DESCRIPTION OF THE DRAWINGS

The foregoing and other advantages of the invention will become apparent upon reading the following detailed description and upon reference to the drawings in which:

FIG. 1*c* is a perspective view of a prior art door guard;

FIG. 1*e* is a sectional view of the door assembly and door guards of FIG. 1*d;*

FIG. 2 is a top view showing a door guard according to one embodiment of the present invention in an inital, unfolded configuration;

Figure 1A:
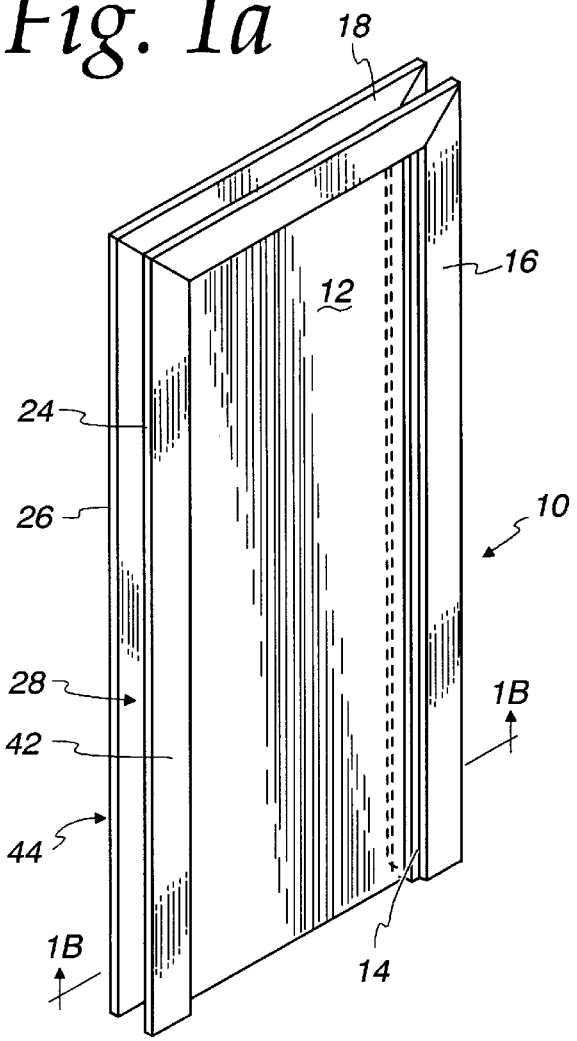
FIG. 1*a* is a perspective view depicting a typical door assembly upon which the door guards of the present invention may be used.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Figure 1D:
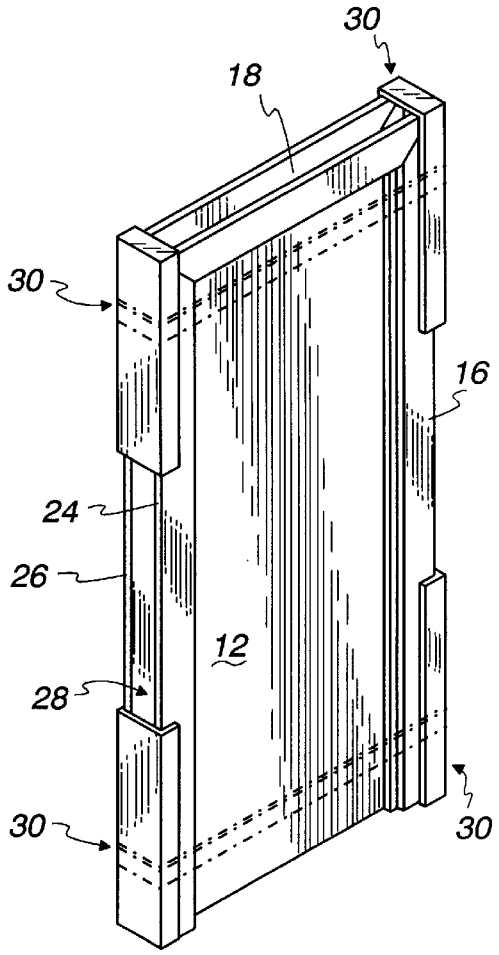
Fig. 1d (Prior Art)
FIG. 1*d* is a perspective view depicting prior art door guards attached to the door assembly of FIG. 1*a;*
Figure 1B:
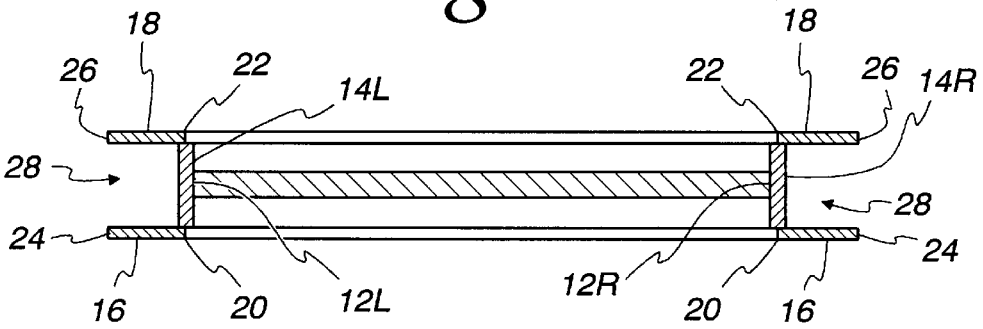
FIG. 1*b* is a sectional view of the door assembly of FIG. 1*a;*

Turning now to the drawings and referring initially to FIGS. 1*a* and 1*b,* there is shown a door assembly 10 upon which the door guards of the present invention may be advantageously employed. The door assembly 10 of FIG. 1*a* is a "generic" door assembly in that it illustrates the general structure of a typical door assembly. It will be appreciated, however, that the present invention may be utilized with door assemblies which differ in structure and appearance from the generic door assembly 10. The door assembly 10 consists generally of a door 12 connected by one or more hinges (not shown) to a door frame 14. The door frame 14 is connected to front and back moldings 16, 18. The door frame 14 is constructed from left and right vertical panels 141, 14*r* adjacent to respective left and right edges 121, 12*r* of the door and a top horizontal panel 14t adjacent to a top edge 12*t* of the door. (The top horizontal panel 14*t* and top edge 12*t* of the door are not visible in FIGS. 1*a* or 1*b.*) The front moldings 16 are connected to front edges 20 of the door frame panels 14 and the back moldings 18 are connected to back edges 22 of the door frame panels 14. The front and back moldings 16, 18 terminate at respective outer edges 24, 26 defining channels 28 therebetween.

FIG. 1*c* illustrates a prior art door guard 30 which maybe used to protect a door assembly 10 of the type shown in FIG. 1*a*. The door guard 30 comprises a four-sided corrugated cardboard "box" including a base 34, a first and second side panel 36, 38 and an end panel 40. To construct the prior art door guard 30, the first and second end panels 36, 38 are folded about ninety degrees relative to the base 52. End tabs 36*a,* 38*a* are hingedly connected to the respective first and second side panels 36, 38. When the door guard 30 is fully assembled, as best shown in FIG. 1*c,* the end tabs 36*a,* 38*a* are folded inwardly to a position about ninety degrees relative to the respective side panels 36, 38. The end panel 40 is then folded over the end tabs 36*a,* 38*a,* to a position about ninety degrees relative to the base 34. The combination of end panel 40 and end tabs 36*a,* 38*a* provide two layers of thickness at the closed end of the prior art door guard 30.

FIGS. 1*d* and 1*e* show the prior art door guard 30 of FIG. 1*c* attached to the door assembly 10 of FIG. 1*a*. Generally, as best shown in FIG. 1*d,* four door guards 30 are positioned about the door assembly 10 and secured by tightening straps 32. When in position about the door assembly 10, the base 34 of each of the door guards 30 engages the outer edges 24, 26 of the front and back moldings 16, 18 and covers the channel 28 between the moldings 16, 18. The first and second side panels 36, 38 engage outer surfaces 42, 44 of the front and back moldings 16, 18. The prior art door guards 30, when secured in position about the door assembly 10 by the tightening straps 32, cover and offer a degree of protection to the front and back moldings 16, 18 in the comer regions of the door assembly 10. However, the prior art door guards 30 generally do not remain secured in position. During shipping and handling of the door assembly 10, the tightening straps 32 which hold the door guards 30 in position tend to become loosened and/or slide in relation to the door guards 30, which in turn causes the door guards 30 to shift out of position or fall off the door assembly 10 entirely. A contributing factor to this problem is that the tightening straps 32 cannot be secured too tightly without causing the front and back moldings 16, 18 to collapse inwardly and destroy the door assembly 10.

Turning now to FIG. 2, there is shown an outer surface of a door guard 50 according to one embodiment of the present invention in an inital, unfolded configuration. In this embodiment, the door guard 50 is a unitary composition of molded fiber, manufactured according to methods known in the art. It will be appreciated, however, that the door guard 50 may be constructed from alternative materials and/or methods known in the art. The door guard 50 includes generally a base 52, a first and second side panel 54, 56, a first and second end panel 60, 62, and end tabs 64, 66. The base 52 is hingedly connected to the side panels 54, 56 by respective fold lines 68, 70 and to the first end panel 60 by fold line 72. A longitudinal slot 74 is formed along fold line 72. The end tabs 64, 66 are hingedly connected to the first and second side panels 54, 56 by respective fold lines 76, 78. The first end panel 60 is hingedly connected to the second end panel 62 by fold line 80. A tab 82 is provided adjacent to the second end panel 62, hingedly connected to the second end panel 62 by fold line 84.

A variety of structures are provided on the outer surface of door guard 50, the functions of which will be described in relation to FIGS. 4*a* and 4*b*. The structures include projection pairs 86*a, b* and 88*a, b* on generally opposite sides of the base 52. Each of the projection pairs 86*a, b* and 88*a, b* consist of parallel ridges extending substantially across a width of the base, forming respective guide channels 90, 92 therebetween. A slot 94 extending entirely through the base 52 is provided adjacent to projection pair 88*a, b.* Alternatively or additionally, slot 94 may be provided adjacent to projection pair 86*a, b.* A raised block 96 is provided on the second end panel 62, and a plurality of raised ridges 98 are provided on the first end panel 60. Raised compression ridges 100, 102 are provided substantially along the length of side panels 54, 56. It will be appreciated that any combination of the above structures may be employed on the door guard 50 to overcome the limitations of the prior art.

The door guard 50 may be imprinted or embossed with colors, patterns, symbols, pictures, photographs and the like to convey virtually any desired information about the product or to enhance the visual impact of the product. For example, the door guard 50 may be embossed with the retailer's and/or manufacturer's trademark.

Figure 3A:
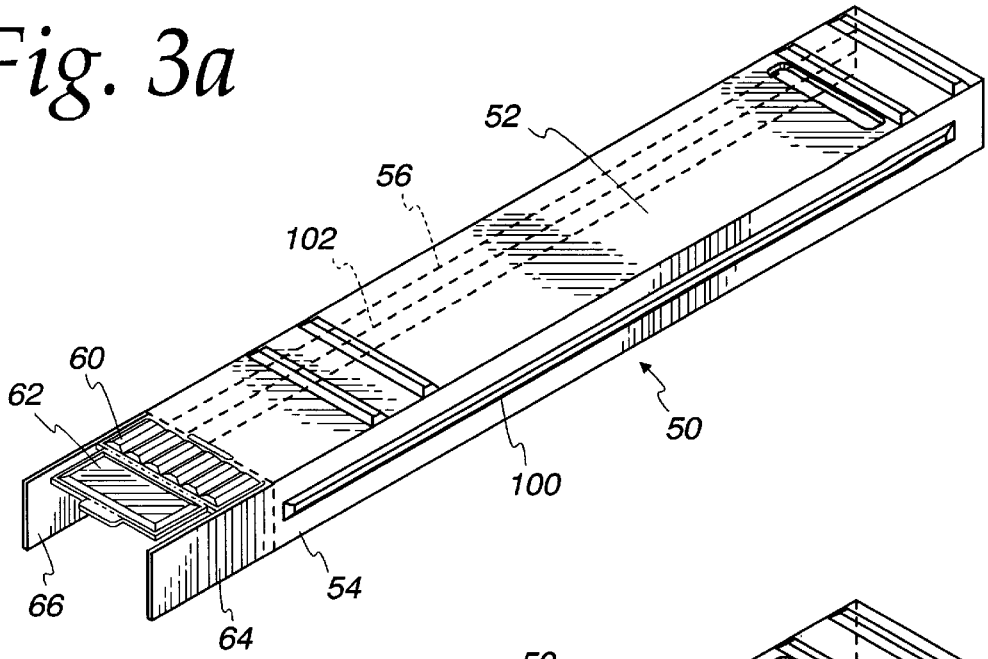
FIG. 3*a* is a perspective view showing the door guard of FIG. 2 after a first folding step has been performed.
Figure 3B:
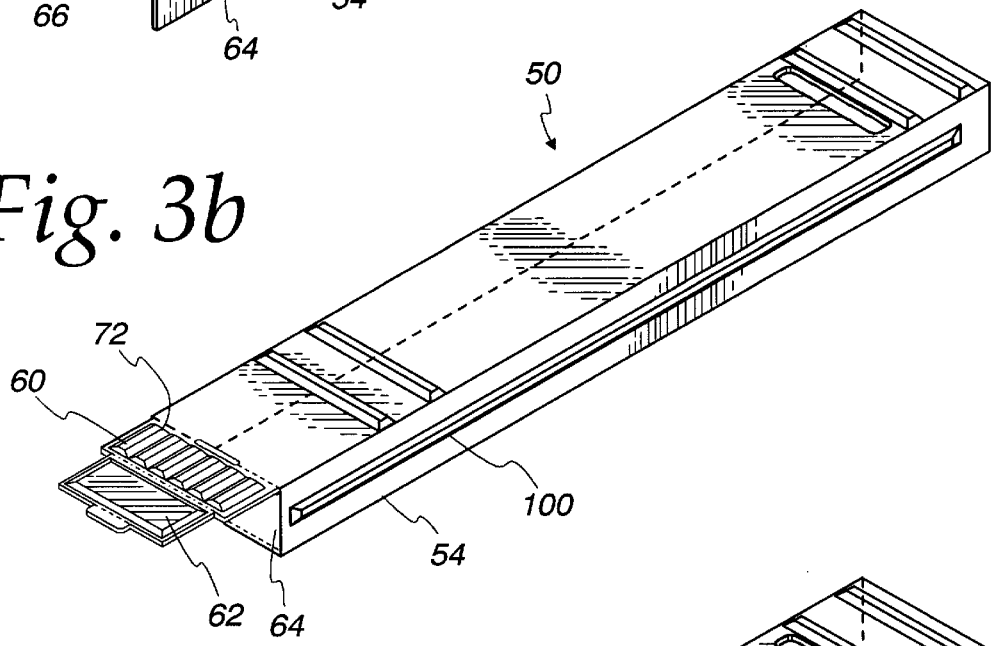
FIG. 3*b* is a perspective view showing the door guard of FIG. 2 after a second folding step has been performed.
Figure 3C:
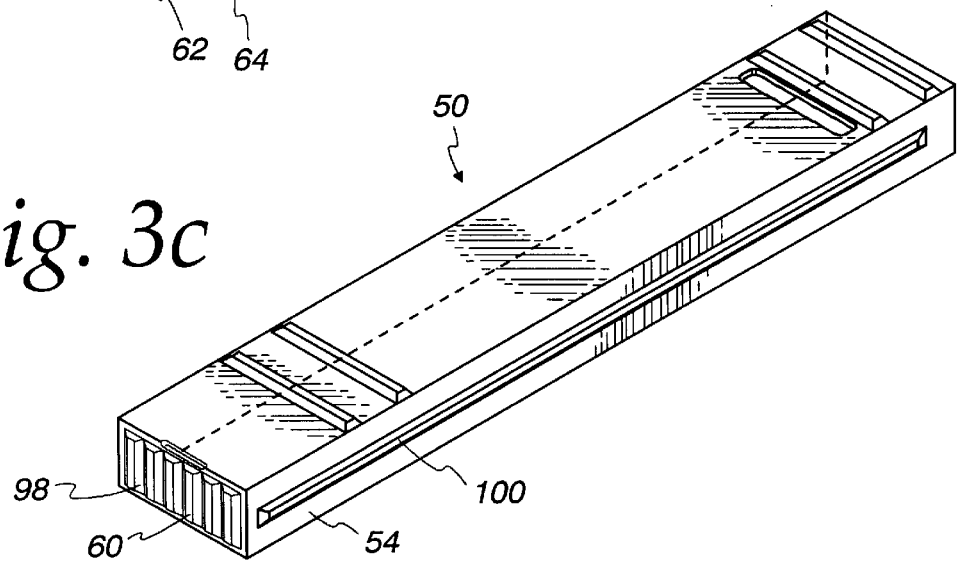
FIG. 3*c* is a perspective view showing the door guard of FIG. 2 in a final configuration, after a third folding step has been performed.

To assemble the door guard 50 from its inital, unfolded configuration (FIG. 2), the first and second side panels 54, 56 are first folded inwardly at about ninety degrees relative to the base 52, such that the raised compression ridges 100, 102 face outwardly. FIG. 3*a* depicts the door guard 50 after completion of this first folding step. Then, the end tabs 64, 66 are folded inwardly at about ninety degrees relative to the respective side panels 54, 56, as shown in FIG. 3*b*. After completion of this second folding step, the end tabs 64, 66 are generally aligned with and lie underneath the fold line 72 between the base 52 and first end panel 60. Next, the first end panel 60 is folded inwardly at about ninety degrees relative to the base 52, to a position overlying the end tabs 64, 66, such that the plurality of raised ridges 98 face outwardly. Finally, the second end panel 62 is folded around and over the end tabs 64, 66, to a position about 180 degrees relative to the first end panel 60, such that the raised block 96 faces inwardly. The second end panel is locked into position by inserting the tab 82 into the longitudinal slot 74. FIG. 3*c* illustrates the door guard 50 after completion of the above folding steps.

Figure 4A:
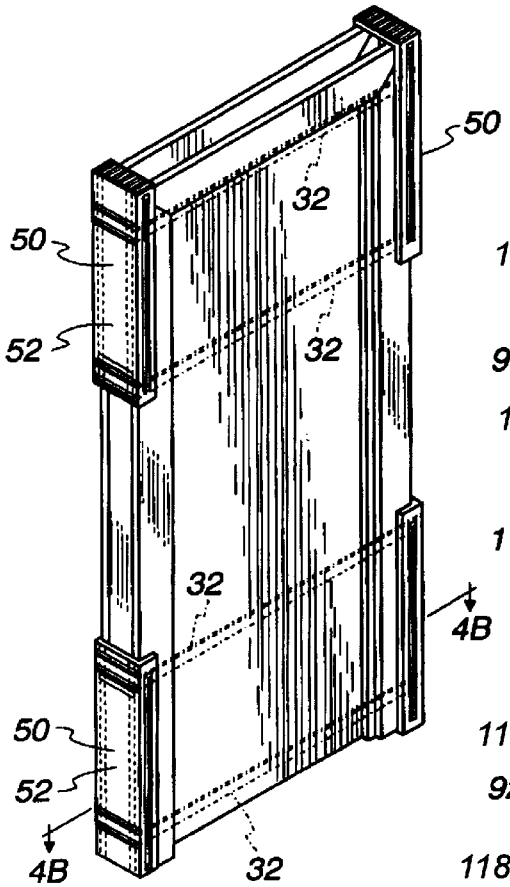
FIG. 4*a* is a perspective view depicting the use of the door guard of FIG. 3*c* to protect the door assembly of FIG. 1*a*.
Figure 4B:
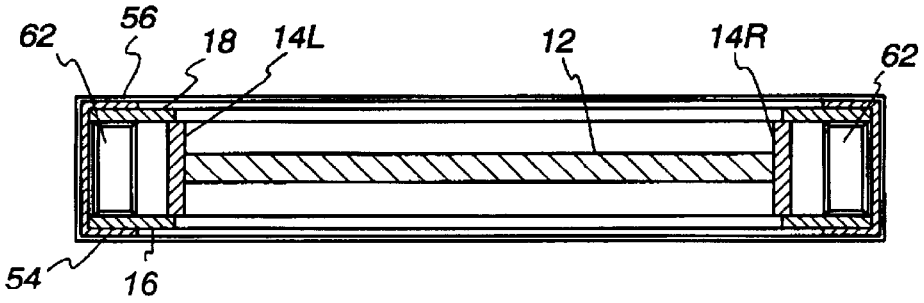
FIG. 4*b* is a sectional view of a portion of the door guard and door assembly of FIG. 4*a;*

Now turning to FIG. 4*a,* there is shown a plurality of door guards 50 arranged about the comers of the door assembly 10 of FIG. 1*a.* FIG. 4*b* is a sectional view of the assembly of FIG. 4*a.* Similar to the prior art door guards 30 (FIGS. 1*c* and 1*d*), the door guards 50 generally comprise four-side "boxes" secured in position about the door assembly 10 by tightening straps 32. Likewise, similar to the prior art, the base 52 of each of the door guards 50 engages the outer edges 24, 26 of the front and back moldings 16, 18, covering the channel 28 between the moldings 16, 18, and the first and second side panels 54, 56 engage outer surfaces 42, 44 of the front and back moldings 16, 18. The door guard 50 according to the present invention nevertheless offers several advantages over the prior art as will become apparent in the following discussion.

The tightening straps 32 for securing the door guards 50 about the door assembly 10 are received within the guide channels 90, 92 formed between the projection pairs 86*a, b* and 88*a, b* on the door guard 50. The projection pairs 86*a, b* and 88*a, b* cause the tightening straps 32 to retain their position within the guide channels 90, 92 even when subjected to shipping and handling forces. More particularly, if the tightening straps 32 shift during shipping and handling, movement of the tightening straps 32 will be restricted to occur within the guide channels 90, 92 because their movement will be impeded by the raised ridges of the projection pairs 86*a, b* and/or 88*a, b.* Therefore, unless the straps 32 become extremely loose, they will remain in position to properly secure the door guards 50 about the door assembly 10.

The raised compression ridges 100, 102 on the outer surfaces of the respective side panels 54, 56 also serve to maintain secure attachment of the door guards 50 to the door assembly 10. When the tightening straps 32 are wrapped about the door guards 50, they contact the raised compression ridges 100, 102 which in turn communicate an inwardly directed tightening force to the respective side panels 54, 56 of the door guard. The tightening force causes the side panels 54, 56 to firmly hug the underlying front and back moldings 16, 18 to a degree which can not be duplicated by prior art door guards 30 (FIGS. 1*c* and 1*d*). The compression ridges 100, 102, in addition to providing an added tightening force relative to the prior art, also provide an added degree of thickness to the side panels 54, 56 for cushioning the underlying front and back moldings 16, 18. In one embodiment, the comers of the compression ridges 100, 102 are rounded so that they do catch on adjacent structures such as other door assemblies 10 and/or their associated door guards 50.

As best observed in FIG. 4*b,* when the door guards 50 are secured in position about the door assembly 10, the raised block 96 on the second end panel 62 projects inwardly into the channel 28 between the front and back moldings 16, 18. The raised block 96 maintains separation of the front and back moldings 16, 18 even when they are subjected to inward pressure from the tightening straps 32. Whereas prior art door guards 30 (FIGS. 1*c* and 1*d*) can not be secured too tightly about the door assembly 10 without causing collapse of the front and back moldings 16, 18, the raised block 96 of the present door guards 50 prevent such an occurrence by restricting inward movement of the front and back moldings 16, 18. More particularly, upon the application of tightening pressure which would otherwise impart inward movement (and ultimately, collapse) of the moldings 16, 18, the respective moldings 16, 18 are prevented from movement as their outer edges 24, 26 encounter the raised edges of the block 96. Because the raised block 96 prevents the moldings 16, 18 from collapse, the strap tension used to secure the door guard 50 to the door assembly 10 may be increased relative to the prior art.

Figure 6:
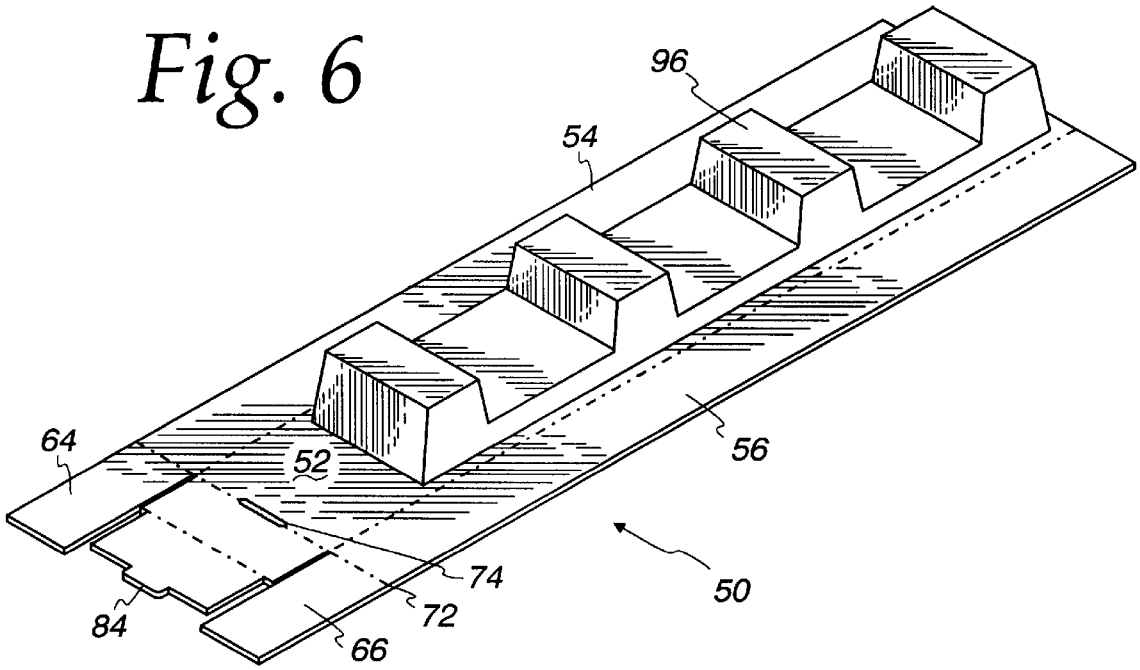
FIG. 6 is a perspective view showing a door guard according to another embodiment of the present invention in an inital, unfolded configuration.
Figure 7:
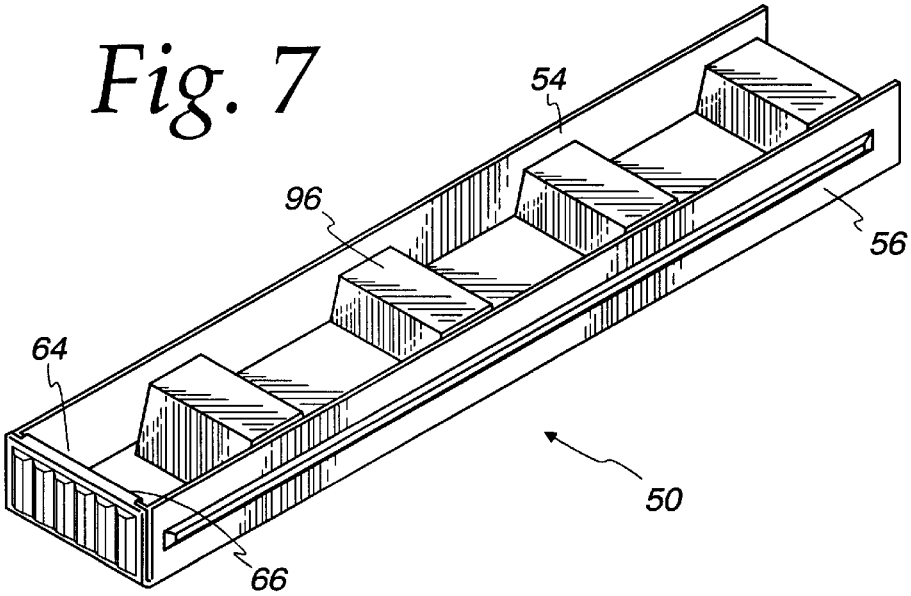
FIG. 7 is a perspective view showing the door guard of FIG. 6 in a final configuration.

Alternatively or additionally, raised blocks 96 may be provided on the inner surface of the base panel 52. FIGS. 6 and 7, for example, show a door guard 50 in an embodiment including a series of raised blocks 96 formed on the inner surface of base panel 52. FIG. 6 shows the door guard 50 in its initial, unfolded configuration and FIG. 7 shows the door guard 50 in its final configuration. The folding of the door guard 50 of FIG. 6 may be accomplished in substantially the same manner described in relation to FIGS. 3*a*–3*c*. The raised blocks 96 on the base panel 52 serve to maintain separation of the front and back moldings 16, 18 upon application of tightening pressure from the straps 32. It will be appreciated that separation of the front and back moldings 16, 18 may be achieved with alternate configurations of raised blocks 96. For example, the raised blocks 96 may be formed more closely together and at progressively increasing and/or decreasing heights to define a "stair-step" configuration on the base panel 52.

In the illustrated embodiment, four layers of protection (consisting of the first and second end panel 60, 62 and the two end tabs 64, 66) are provided to cushion the ends of the door assembly 10 from damage that would otherwise occur, for example, upon sliding or dragging the door assembly on a floor. This is an important feature because door assemblies 10 are commonly displayed in "bookshelf" fashion on a retailer's floor and are usually dragged along the floor as they are pulled out and pushed back from the bookshelf display. In contrast, prior art cardboard door guards 30 (FIGS. 1*c* and 1*d*) generally have only two layers of protection. In the illustrated embodiment, further cushioning protection is provided by the ridges 98 on the first end panel 60 of the door guard 50. It will be appreciated that the configuration, thickness and/or depth of the ridges 98 may be varied as needed or desired, or the ridges 98 may be eliminated altogether.

The slot 94 on the base 52 is provided to facilitate lifting of the door assembly 10. In the illustrated embodiment, the slot 94 comprises an elongated slot oriented in parallel to the longitudinal ridges 88*a, b* of the door guard 50. The slot 94 is positioned adjacent to the ridges 88*a, b* but outside of the channel 92 formed between the ridges 88*a, b.* In one embodiment, the slot 94 is dimensioned to permit a human operator to lift the door assembly 10 by inserting one or more fingers, or a hand, into the opening. In this embodiment, it is preferred that the opening 94 be large enough to accommodate insertion of human fingers, up to at least the first knuckle, through the opening. It will be appreciated, however, that robotic (e.g., machine) "fingers" may also be inserted into the slot 94 to lift the door assembly 10, in which case the opening 94 maybe sized to accommodate the robotic "fingers," rather than human fingers. In either case, lifting of the door assembly 10 is accomplished by inserting one or more fingers (e.g. human or machine) fingers into the slot 94, sliding the fingers underneath the base 52 to a position underneath the guide channel 92, then applying outward pressure to the tightening strap(s) 32 that are positioned within the guide channel 92. When human hands are employed to lift the door assembly 10, the base 52 provides a degree of cushioning between the person's fingers and the straps 32 which permits the door assembly 10 to be lifted with a minimal amount of discomfort.

Figure 5:
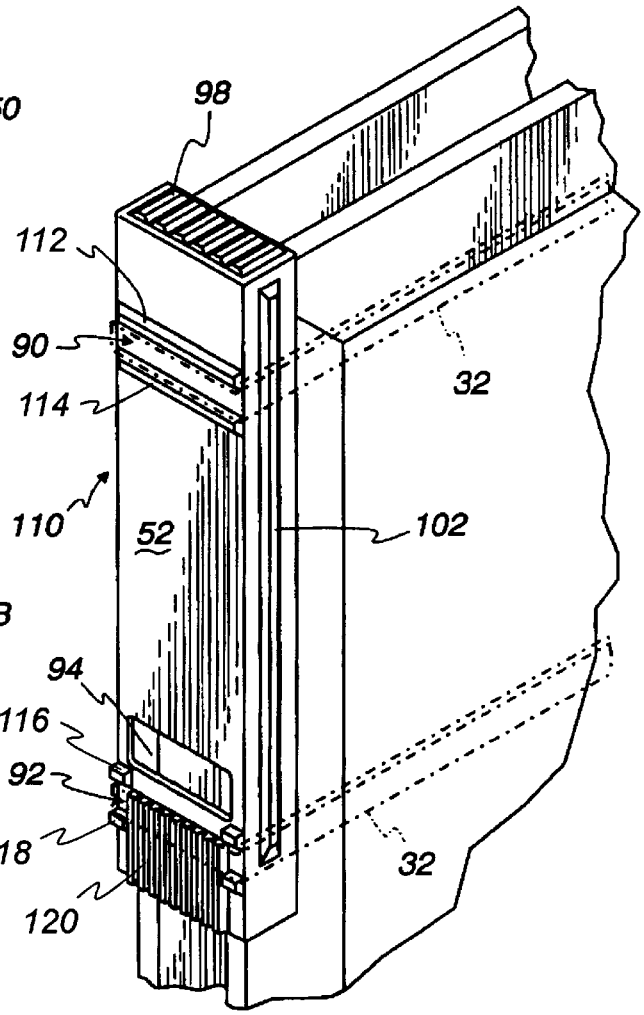
FIG. 5 is a perspective view showing a door guard according to another embodiment of the present invention protecting the door assembly of FIG. 1*a*.

FIG. 5 illustrates another embodiment of door guard according to the present invention, designated by reference numeral 110. The door guard 110 shares several common features with the door guard 50 heretofore described. Common reference numerals will be used herein to designate features which are common to the respective door guards 50 and 100. In one embodiment, the door guard 110 is a unitary composition of molded fiber including a base 52, a first and second side panel 54, 56, a first and second end panel 60, 62, and end tabs 64, 66 manufactured and assembled to form four sided "boxes" to be secured about a door assembly 10 in substantially the same manner as the door guard 50 described in relation to FIGS. 4*a* and 4*b*. Likewise, the door guard 110 similarly includes a plurality of raised ridges 98 on the first end panel 60, a raised block 96 on the second end panel 62 and raised compression ridges 100, 102 along the length of side panels 54, 56, the functions of which have heretofore been described in detail in relation to the door guard 50. It will be appreciated that, like the door guard 50, any combination of the above structures may be employed on the door guard 110 to overcome the limitations of the prior art.

One of the features of the door guard 110 which differs from the door guard 50 relates to the structure of the guide channels 90 and 92 formed on opposite sides of the base 52. Whereas the guide channels 90 and 92 in door guard 50 (FIGS. 4*a* and 4*b*) were formed between parallel ridges 86*a, b* and 88*a, b* extending substantially across the width of the base 52, the guide channel 92 of the door guard 110 are formed by opposing pairs of discrete projections 112, 114 and 116, 118. Each set of projections 112, 114 and 116, 118 are aligned across parallel axes extending across the width of the base 52, so as to form guide channel 92 therebetween. A slot 94 extending entirely through the base 52 is provided adjacent to the guide channel 92. A series of accordian-like ridges 120 are provided within the guide channel 92. The ridges 120 may be confined within the guide channel 92 shown in FIG. 5, or may extend all the way to the bottom (open) end of the door guard 110. The door guard 110 as shown in FIG. 5 may be lifted in substantially the same manner as door guard 50, by inserting one or more fingers into the slot 94, sliding the fingers underneath the base 52 to a position underneath the guide channel 92, then applying outward pressure to the tightening strap(s) 32 that are positioned within the guide channel 92. Upon application of lifting pressure to the guide channel 92 which would otherwise tend to rip or tear the door guard, the accordian-like ridges 120 are adapted to deform and stretch to resist tearing. It will be appreciated that features of the door guard 110 heretofore described may be selectively incorporated into the door guard 50 described in relation to FIGS. 4*a* and 4*b*. For example, one end of the door guard may be provided with parallel ridges 86*a, b* and 88*a, b* extending substantially across the width of the base 52, and the other end of the door guard may be provided with opposing pairs of discrete projections 112, 114 and 116, 118 as shown in FIG. 5. Accordian-like ridges 120 may similarly be provided on either end of the door guard.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A door guard for protecting portions of a door assembly, the door assembly including a door frame and moldings positioned about a door, the moldings including front and back moldings defining a channel therebetween, the door guard comprising:

a base adapted to engage outer edges of the front and back moldings of the door assembly, the base having an outer surface including groups of projections defining guide channels therebetween, the guide channels being adapted to receive tightening straps for securing the base to the door assembly;

a first and second side panel connected to the base, the first and second side panel adapted to engage outer surfaces of the front and back moldings of the door assembly, each of the side panels being adapted to receive tightening straps thereon and compress inwardly to secure the side panels to the door assembly; and an end section connected to the base, the end section being adapted to engage end portions of the front and back moldings of the door assembly.

2. The door guard according to claim 1 including a raised block adapted to project into the channel between the front and back moldings, the raised block being adapted to maintain separation of the front and back moldings in response to compression of the moldings by said tightening straps.

3. The door guard according to claim 2 wherein the raised block projects between the end portions of the front and back moldings of the door assembly.

4. The door guard of claim 3 wherein the raised block comprises a portion of the end section.

5. The door guard of claim 2 wherein the raised block comprises a portion of the base.

6. A door guard for protecting portions of a door assembly, the door assembly including a door frame and moldings positioned about a door, the moldings including front and back moldings defining a channel therebetween, the door guard comprising:

a base adapted to engage outer edges of the front and back moldings of the door assembly, the base having an outer surface including groups of projections defining guide channels therebetween, the guide channels being adapted to receive tightening straps for securing the base to the door assembly;

a first and second side panel connected to the base, the first and second side panel adapted to engage outer surfaces of the front and back moldings of the door assembly, each of the side panels being adapted to receive tightening straps thereon and compress inwardly to secure the side panels to the door assembly, the first and second side panels having respective outer surfaces including a raised compression ridge, the compression ridges being adapted to communicate a tightening force to the side panels in response to inward compression of the side panels by said tightening straps; and an end section connected to the base, the end section being adapted to engage end portions of the front and back moldings of the door assembly.

7. A door guard for protecting portions of a door assembly the door assembly including a door frame and moldings positioned about a door, the moldings including front and back moldings defining a channel therebetween, the door guard comprising:

a base adapted to engage outer edaes of the front and back moldings of the door assembly, the base having an outer surface including groups of projections defining guide channels therebetween, the guide channels being adapted to receive tightening straps for securing the base to the door assembly;

a first and second side panel connected to the base, the first and second side panel adapted to engage outer surfaces of the front and back moldings of the door assembly, each of the side panels being adapted to receive tightening straps thereon and compress inwardly to secure the side panels to the door assembly; and an end section connected to the base, the end section being adapted to engage end portions of the front and back moldings of the door assembly, the end section having an outer surface including a plurality of raised ridges defining a pad for cushioning the end portions of the front and back moldings of the door assembly.

8. The door guard according to claim 1 wherein the groups of projections defining said guide channels comprise opposing pairs of parallel ridges integral with and extending substantially across a width of the base.

9. A door guard for protecting portions of a door assemble the door assembly including a door frame and moldings positioned about a door, the moldings including front and back moldings defining a channel therebetween, the door guard comprising:

a base adapted to engage outer edges of the front and back moldings of the door assembly, the base having an outer surface including groups of projections defining guide channels therebetween, the groups of projections defining said guide channels comprising a plurality of projections aligned along opposing parallel axes and extending across a width of the base, the guide channels being adapted to receive tightening straps for securing the base to the door assembly;

a first and second side panel connected to the base, the first and second side panel adapted to engage outer surfaces of the front and back moldings of the door assembly each of the side panels being adapted to receive tightening straps thereon and compress inwardly to secure the side panels to the door assembly; and an end section connected to the base, the end section being adapted to engage end portions of the front and back moldings of the door assembly.

10. The door guard according to claim 9 further comprising a plurality of accordian-like ridges positioned within said guide channels between said parallel axes, the accordian-like ridges being adapted to deform upon application of pressure thereto to resist tearing.

11. The door guard according to claim 1 comprising a unitary composition of molded fiber.

12. A door guard for protecting portions of a door assembly, the door assembly including a door frame and moldings positioned about a door, the moldings including front and back moldings defining a channel therebetween, the door guard comprising:

a base adapted to engage outer edges of the front and back moldings of the door assembly;

a first and second side panel connected to the base, the first and second side panel adapted to engage outer surfaces of the front and back moldings of the door assembly, each of the side panels receiving tightening straps thereon and compressing inwardly to secure the side panels to the door assembly; and an end section connected to the base, the end section being adapted to engage end portions of the front and back moldings of the door assembly, the end section including a raised block adapted to project into the channel between the front and back moldings, the raised block being adapted to maintain separation of the front and back moldings in response to compression of the moldings by said tightening straps.

13. The door guard according to claim 12 wherein the base has an outer surface including groups of projections defining guide channels therebetween, the guide channels being adapted to receive said tightening straps.

14. A door guard for protecting portions of a door assembly, the door assembly including a door frame and moldings positioned about a door, the moldings including front and back moldings defining a channel therebetween, the door guard comprising:

a base adapted to engage outer edges of the front and back moldings of the door assembly;

a first and second side panel connected to the base, the first and second side panel adapted to engage outer surfaces of the front and back moldings of the door assembly, each of the side panels being adapted to receive tightening straps thereon and compress inwardly to secure the side panels to the door assembly, the first and second side panels having outer surfaces including a raised compression ridge, the compression ridges being adapted to communicate a tightening force to the side panels in response to inward compression of the side panels by said tightening straps; and an end section connected to the base, the end section being adapted to engage end portions of the front and back moldings of the door assembly, the end section including a raised block adapted to project into the channel between the front and back moldings, the raised block being adapted to maintain separation of the front and back moldings in response to compression of the moldings by said tightening straps.

15. The door guard according to claim 12 comprising a unitary composition of molded fiber.

16. A door guard for protecting portions of a door assembly, the door assembly including a door frame and moldings positioned about a door, the moldings including front and back moldings defining a channel therebetween, the door guard comprising:

a base adapted to engage outer edges of the front and back moldings of the door assembly;

a first and second side panel connected to the base, the first and second side panels being adapted to engage outer surfaces of the front and back moldings of the door assembly, each of the side panels being adapted to receive tightening straps thereon and compress inwardly to secure the side panels to the door assembly, the side panels each having outer surfaces including a raised compression ridge, the compression ridges being adapted to communicate a tightening force to the side panels in response to inward compression of the side panels by said tightening straps; and an end section connected to the base, the end section being adapted to engage end portions of the front and back moldings of the door assembly.

17. The door guard according to claim 16 wherein the base has an outer surface including groups of projections defining guide channels therebetween, the guide channels being adapted to receive said tightening straps.

18. The door guard according to claim 16 including a raised block adapted to project into the channel between the front and back moldings, the raised block being adapted to maintain separation of the front and back moldings in response to compression of the moldings by said tightening straps.

19. The door guard according to claim 18 wherein the raised block projects between the end portions of the front and back moldings of the door assembly.

20. The door guard of claim 19 wherein the raised block comprises a portion of the end section.

21. The door guard of claim 18 wherein the raised block comprises a portion of the base.

22. The door guard according to claim 16 comprising a unitary composition of molded fiber.

23. A molded fiber door guard for protecting portions of a door assembly, the door assembly including a door frame and moldings positioned about a door, the moldings including front and back moldings defining a channel therebetween, the door guard comprising:

a base adapted to engage outer edges of the front and back moldings of the door assembly, the base having an outer surface including groups of projections defining guide channels therebetween adapted to receive tightening straps for securing the base to the door assembly;

a first and second side panel connected to the base, the first and second side panels having respective inner surfaces adapted to engage outer surfaces of the front and back moldings of the door assembly, the first and second side panels having respective outer surfaces including a raised compression ridge, the compression ridges being adapted to communicate a tightening force to the side panels in response to inward compression of the side panels by said tightening straps; and an end section connected to the base, the end section having an inner surface adapted to engage end portions of the front and back moldings of the door assembly, the inner surface including a raised block adapted to project into the channel between the front and back moldings, the raised block being adapted to maintain separation of the front and back moldings in response to compression of the moldings by said tightening straps, the end section having an outer surface including a plurality of raised ridges defining a pad for cushioning the end portions of the front and back moldings of the door assembly.

24. In combination, a door assembly and a plurality of door guards for protecting portions of the door assembly, the door assembly including a door frame and moldings positioned about a door, the moldings including front and back moldings defining a channel therebetween, each of the door guards comprising:

a base adapted to engage outer edges of the front and back moldings of the door assembly, the base having an outer surface including groups of projections defining guide channels therebetween adapted to receive tightening straps for securing the base to the door assembly;

a first and second side panel connected to the base, the first and second side panel adapted to engage outer surfaces of the front and back moldings of the door assembly, each of the side panels being adapted to receive tightening straps thereon and compress inwardly to secure the side panels to the door assembly; and an end section connected to the base, the end section being adapted to engage end portions of the front and back moldings of the door assembly.

25. The combination of claim 24 wherein each of the door guards includes a raised block adapted to project into the channel between the front and back moldings, the raised block being adapted to maintain separation of the front and back moldings in response to compression of the moldings by said tightening straps.

26. The combination of claim 25 wherein the raised block on each of the door guards projects between respective ones of the end portions of the front and back moldings of the door assembly.

27. The combination of claim 26 wherein the raised block on each of the door guards comprises a portion of the end section of the respective door guards.

28. The combination of claim 25 wherein the raised block on each of the door guards comprises a portion of the base of the respective door guards.

29. In combination, a door assembly and a plurality of door guards for protecting portions of the door assembly, the door assembly including a door frame and moldings positioned about a door, the moldings including front and back moldings defining a channel therebetween, each of the door guards comprising:

a base adapted to engage outer edges of the front and back moldings of the door assembly, the base having an outer surface including groups of projections defining guide channels therebetween adapted to receive tightening straps for securing the base to the door assembly;

a first and second side panel connected to the base, the first and second side panel adapted to engage outer surfaces of the front and back moldings of the door assembly, each of the side panels being adapted to receive tightening straps thereon and compress inwardly to secure the side panels to the door assembly; and an end section connected to the base, the end section being adapted to engaae end portions of the front and back moldings of the door assembly, the end section of the door guards having an outer surface including a plurality of raised ridges defining a pad for cushioning the end portions of the front and back moldings of the door assembly.

30. In combination, a door assembly and a plurality of door guards for protecting portions of the door assembly the door assembly including a door frame and moldings positioned about a door, the moldings including front and back moldings defining a channel therebetween, each of the door guards comprising:

a base adapted to engage outer edges of the front and back moldings of the door assembly, the base having an outer surface including groups of projections defining guide channels therebetween adapted to receive tightening straps for securing the base to the door assembly;

a first and second side panel connected to the base, the first and second side panel adapted to engage outer surfaces of the front and back moldings of the door assembly each of the side panels being adapted to receive tightening straps thereon and compress inwardly to secure the side panels to the door assembly, the first and second side panels of the door guards having outer surfaces including a raised compression ridge, the compression ridges being adapted to communicate a tightening force to the side panels in response to inward compression of the side panels by said tightening straps; and an end section connected to the base, the end section being adapted to engage end portions of the front and back moldings of the door assembly.

31. The combination of claim 24 wherein the plurality of door guards are formed from unitary compositions of molded fiber.

32. A method of protecting a portion of a door assembly with a door guard, the door assembly including a door frame and moldings positioned about a door, the moldings including front and back moldings defining a channel therebetween, the door guard comprising a unitary composition of molded fiber including a base connected to first and second side panels and an end section, the base having an outer surface including groups of projections defining guide channels therebetween, the first and second side panels having outer surfaces including a raised compression ridge, the end section having an inner surface including a raised block, the method comprising the steps of:

(a) placing the door guard adjacent a selected comer region of the door assembly, the door guard being placed in vertical orientation with the base engaging vertical edges of the front and back moldings adjacent the selected comer region of the door assembly, the first and second side panels engaging outer surfaces of the front and back moldings adjacent the selected comer region of the door assembly, the end section engaging ends of the front and back moldings adjacent the selected comer region of the door assembly, the raised block projecting into the channel between the front and back moldings adjacent the selected comer region of the door assembly; and (b) tightly securing the door guard to the door assembly with a plurality of tightening straps, the tightening straps being aligned within the guide channels of the door guard and wrapped around the door assembly, the tightening straps engaging the compression ridges and compressing the side panels of the door guard, the raised block of the door guard maintaining separation of the front and back moldings in response to compression of the side panels of the door guard.

33. The method of claim 32 wherein steps (a) and (b) are accomplished four times with four respective door guards to protect four comer regions of the door assembly.

* * * * *

UNITED STATES PATENT AND TRADEMARK OFFICE

CERTIFICATE OF CORRECTION

PATENT NO. : 6,029,410

DATED : February 29, 2000

INVENTOR(S) : John K. Westberg, II et al

It is certified that error appears in the above-identified patent and that said Letters Patent is hereby corrected as shown below:

| | |
|---|---|
| Column 8, Claim 7, line 64 | replace "edaes" with --edges--. |
| Column 9, Claim 9, line 20 | replace "assemble" with –assembly--. |
| Column 12, Claim 29, line 31 | replace "engaae" with –engage--. |
| Column 12, Claim 30, line 38 | insert --,-- after "assembly" and before "the". |
| Column 12, Claim 30, line 51 | insert --,-- after "assembly" and before "each". |

Signed and Sealed this

Thirteenth Day of February, 2001

*Attest:*

Nicholas P. Godici

NICHOLAS P. GODICI

*Attesting Officer*

*Acting Director of the United States Patent and Trademark Office*